US008721267B2

(12) United States Patent
Moss et al.

(10) Patent No.: US 8,721,267 B2
(45) Date of Patent: May 13, 2014

(54) SUBMERSIBLE PUMP UTILIZING MAGNETIC CLUTCH ACTIVATED IMPELLER

(75) Inventors: Robert A. Moss, Simsbury, CT (US); Jeremy R. Baillargeon, Southington, CT (US); Joseph Tessitore, Winston-Salem, NC (US)

(73) Assignee: Veeder-Root Company, Simsbury, CT (US)

( * ) Notice: Subject to any disclaimer, the term of this patent is extended or adjusted under 35 U.S.C. 154(b) by 478 days.

(21) Appl. No.: 13/115,856

(22) Filed: May 25, 2011

(65) Prior Publication Data

US 2012/0051944 A1 Mar. 1, 2012

Related U.S. Application Data

(60) Provisional application No. 61/348,077, filed on May 25, 2010.

(51) Int. Cl.
*F04D 29/00* (2006.01)

(52) U.S. Cl.
USPC ..... 415/140; 415/123; 415/211.2; 415/229; 416/135; 416/169 R; 416/170 R

(58) Field of Classification Search
CPC ..... F04D 29/444; F04D 13/08
USPC ..... 415/1, 123, 140, 211.2, 229; 416/135, 416/169 R, 170 R; 417/420, 423.3, 424.1
See application file for complete search history.

(56) References Cited

U.S. PATENT DOCUMENTS

| | | | | |
|---|---|---|---|---|
| 2,556,854 | A * | 6/1951 | Spears et al. | 310/104 |
| 3,411,450 | A * | 11/1968 | Clifton | 417/420 |
| 4,982,461 | A * | 1/1991 | Mikiya et al. | 4/541.3 |
| 5,799,834 | A | 9/1998 | Small et al. | |
| 5,853,113 | A | 12/1998 | Small et al. | |
| 5,921,441 | A | 7/1999 | Small et al. | |
| 6,126,409 | A | 10/2000 | Young | |
| 6,129,529 | A | 10/2000 | Young et al. | |
| 6,158,460 | A | 12/2000 | Clark et al. | |
| 6,223,765 | B1 | 5/2001 | Small et al. | |
| 6,625,519 | B2 | 9/2003 | Goodwin et al. | |
| 6,978,660 | B2 | 12/2005 | Hutchinson et al. | |

(Continued)

FOREIGN PATENT DOCUMENTS

EP 1035389 A2 9/2000

OTHER PUBLICATIONS

International Search Report and Written Opinion issued on Sep. 15, 2011 regarding corresponding International application No. PCT/US2011/037973.

*Primary Examiner* — Ninh H Nguyen
(74) *Attorney, Agent, or Firm* — Nelson Mullins Riley & Scarborough LLP

(57) ABSTRACT

A pumping apparatus comprises a rotatable shaft coupled to a motor. At least one control structure is mounted on the shaft, and at least one impeller is carried by the shaft. The impeller is adapted to rotate independently of the shaft so as to pump a fluid. The apparatus also comprises a magnetic coupling between the control structure and the impeller. Further, the impeller is adapted to translate axially along the shaft in response to a change in downstream pressure to alter the strength of the magnetic coupling.

27 Claims, 5 Drawing Sheets

(56) References Cited

U.S. PATENT DOCUMENTS

| | | | | |
|---|---|---|---|---|
| 7,010,961 | B2 | 3/2006 | Hutchinson et al. | |
| 7,059,366 | B2 | 6/2006 | Dolson | |
| 7,076,994 | B2 | 7/2006 | Hutchinson et al. | |
| 7,318,708 | B2 | 1/2008 | Dolson | |
| 7,434,983 | B2 * | 10/2008 | Terentiev | 366/273 |
| 7,726,336 | B2 | 6/2010 | Dolson | |
| 2002/0068000 | A1 | 6/2002 | Martin et al. | |

* cited by examiner

SUBMERSIBLE PUMP UTILIZING MAGNETIC CLUTCH ACTIVATED IMPELLER

FIELD OF THE INVENTION

The present invention relates generally to a submersible pump for pumping liquid fuel. More particularly, the invention relates to a submersible pump utilizing a magnetic clutch activated impeller for controlling pressure during periods of low or no flow.

BACKGROUND OF THE INVENTION

Gasoline service stations normally have underground storage tanks (USTs) from which fuel is pumped to dispensers. A typical installation makes use of a unitized motor and pump (UMP) in the storage tank which operates using one or more impellers to pump gasoline or another liquid fuel to a distribution head located above the tank. The flow path for the fuel includes a vertical column pipe which extends from the pump to the distribution head. From the distribution head, the fuel is supplied to one or more dispensers, each of which may have multiple fueling positions. The fuel is then delivered to a customer's vehicle tank via a hose and nozzle at each fueling position.

Governmental regulations typically limit the flow rate of fuel at each nozzle, for example to 10 gallons per minute. Because service station owners have an interest in servicing customers as quickly as possible, they desire a fuel flow rate approaching this maximum.

Submersible pumps are often configured to operate the impeller(s) at a constant RPM even if fuel is not being dispensed. However, operating the pump at a fixed speed may create undesirable high pressures during low or no flow conditions. In particular, when the pump is on and all nozzles are open, pressure in the pump is relatively low. This causes low flow rates at each nozzle. Thus, in some installations two or more UMPs may be manifolded together to achieve higher flow rates when a large number of nozzles are simultaneously open. In any case, when the pump is on and less fuel is being dispensed (i.e., one or more nozzles is closed), the pressure in the pump will increase. This pressure during a stopped flow condition (i.e., all nozzles are closed) may be high enough to damage components of the fuel dispensing system.

One prior art solution involves using a variable speed drive (VSD) to control the speed of the impellers in a low or no flow condition. These systems employ some method of feedback to determine when to reduce the impeller speed. For example, a VSD may be provided with a pressure transducer or it may monitor the current delivered to the pump motor. However, the VSD and its associated feedback devices are complex and expensive.

FIG. 1 illustrates the above-described operating characteristics of a standard constant speed UMP, a manifolded constant speed UMP, and a UMP using a VSD as the number of nozzles in operation increases.

Another potential solution involves using a bypass valve to divert fuel back to the UST during low flow conditions, thereby limiting the pressure. However, this may interfere with existing devices required for leak detection. Specifically, environmental regulations require that USTs be monitored for leaks, and typically a liquid level float is provided for this purpose. The liquid level float is adapted to detect small changes in liquid level to identify potential leaks. Because diverting fuel back into the tank causes liquid surface disturbances, this solution could interfere with the float's operation.

SUMMARY OF THE INVENTION

The present invention recognizes and addresses disadvantages of prior art constructions and methods. According to one embodiment, the present invention provides a pumping apparatus comprising a pump housing disposed in a storage tank and in fluid communication with fluid piping. The pumping apparatus comprises a rotatable shaft and at least one magnetic clutch assembly coupled with the shaft and configured to pump fluid from the storage tank through the pump housing to the fluid piping. The at least one magnetic clutch assembly comprises an impeller, a control structure, and a magnetic coupling between the impeller and the control structure. The magnetic coupling is defined by a conductive portion and a plurality of magnets proximate the conductive portion such that rotation of the control structure causes rotation of the impeller. The impeller is configured to travel along the shaft relative to the control structure in response to a change in downstream pressure.

According to a further embodiment, the present invention provides a pumping apparatus comprising a rotatable shaft coupled to a motor. At least one control structure is mounted on the shaft, and at least one impeller is carried by the shaft. The impeller is adapted to rotate independently of the shaft so as to pump a fluid. The apparatus also comprises a magnetic coupling between the control structure and the impeller. Further, the impeller is adapted to translate axially along the shaft in response to a change in downstream pressure to alter the strength of the magnetic coupling.

According to a further embodiment, the present invention provides a method for pumping fluid from a storage tank to fluid piping. The method comprises providing a pump housing having an inlet in fluid communication with the fluid and an outlet in fluid communication with the fluid piping. The method also comprises providing a rotatable shaft located inside the housing, the shaft being in operative communication with a motor. The method also comprises coupling an impeller with the shaft, the coupling allowing the impeller to rotate independently of and translate axially along the shaft. Further, the method comprises mounting a control structure on the shaft such that the control structure rotates with the shaft and magnetically coupling the control structure with the impeller. Finally, the method comprises rotating the control structure to draw the fluid into the inlet using the impeller and altering the strength of the magnetic coupling between the control structure and the impeller in response to a change in downstream pressure.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
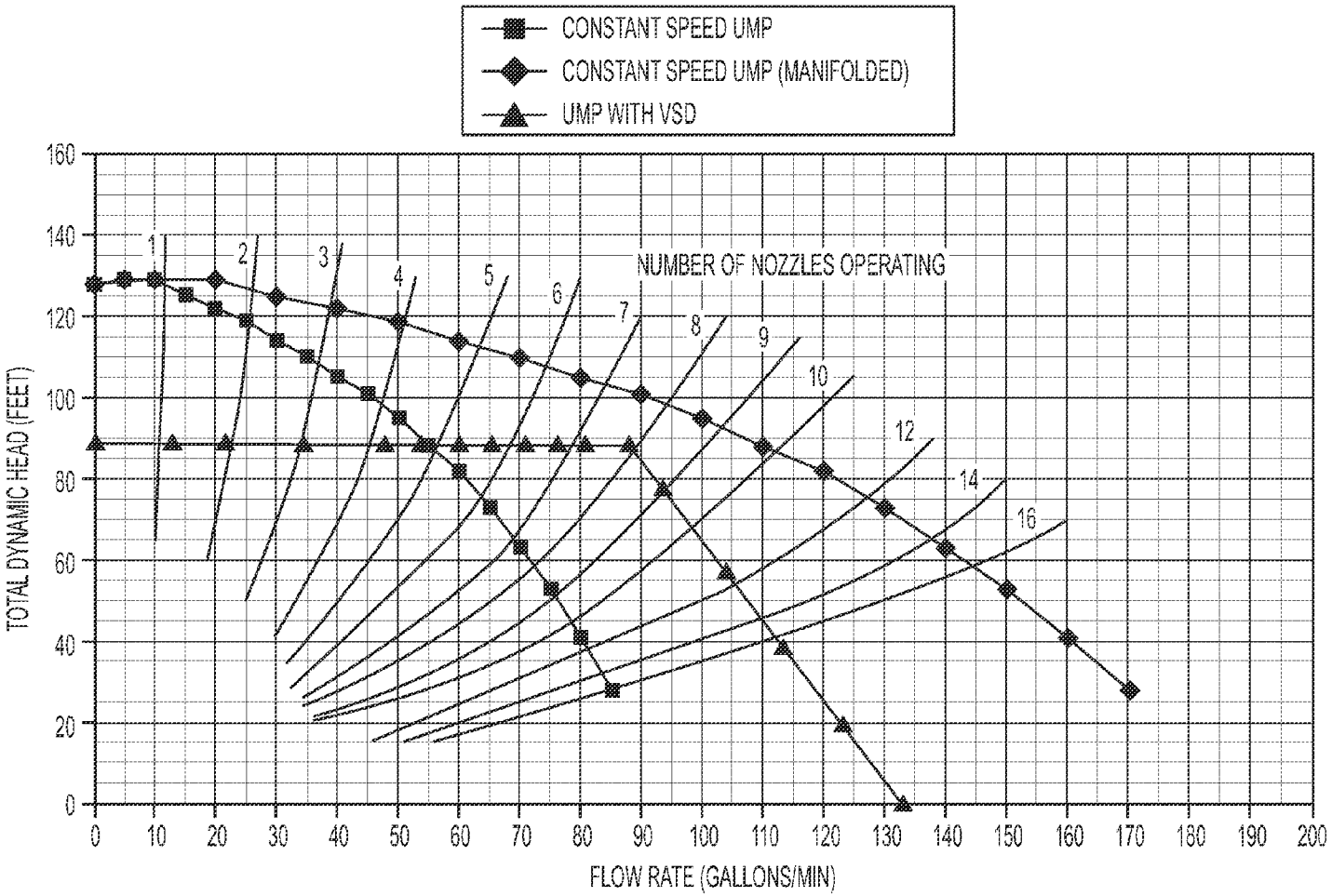
FIG. 1 is an exemplary graph illustrating the relationship between total dynamic head and flow rate of liquid fuel for a standard constant speed UMP, a manifolded constant speed UMP, and a UMP using a variable-speed drive (VSD).

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of any appended claims and their equivalents.

The present invention provides a submersible pump having at least one impeller driven via a magnetic clutch. The magnetic clutch comprises a magnetic coupling which imparts a torque to the impeller that varies as a function of the pressure difference across the impeller.

Figure 2:
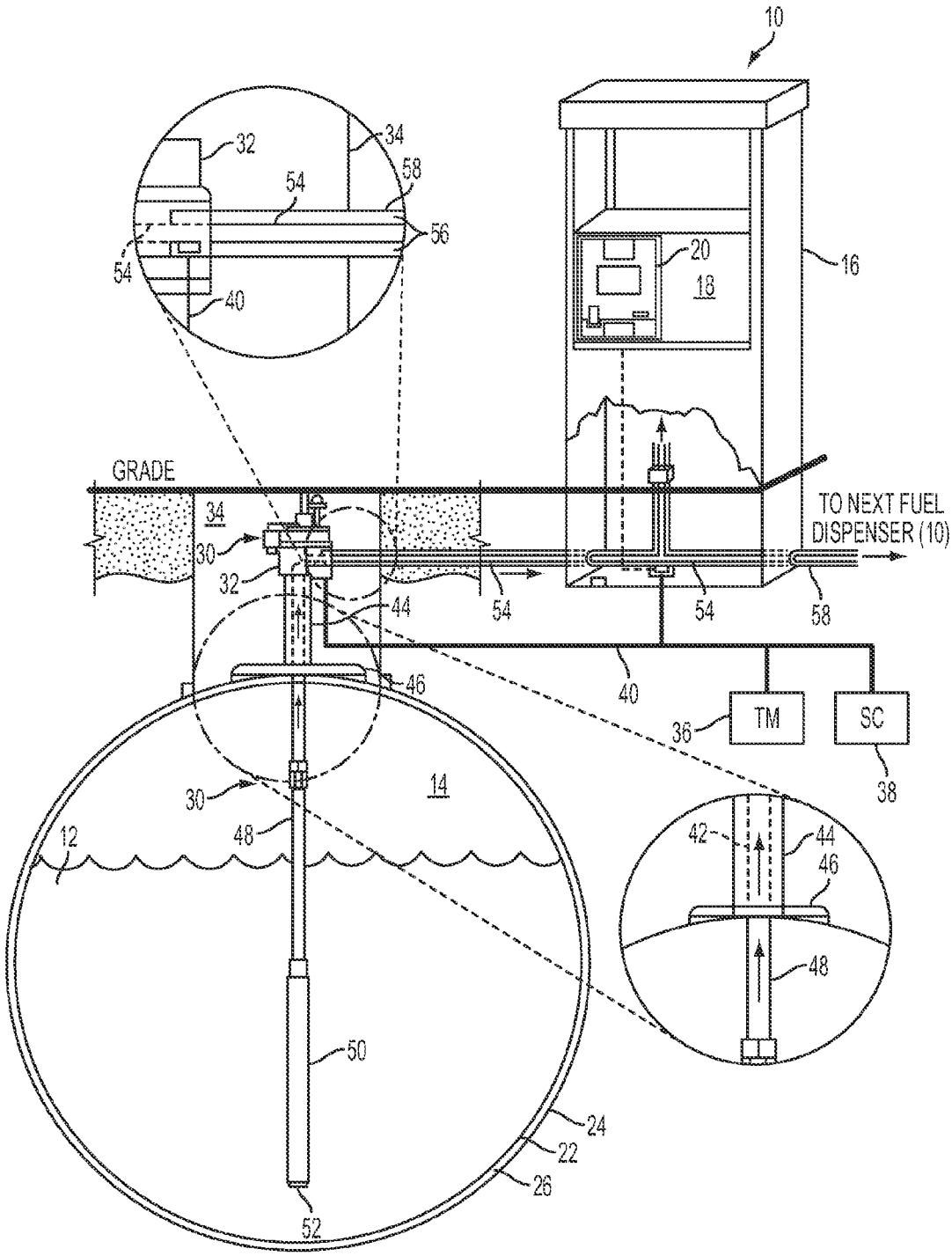
FIG. 2 is a diagrammatic representation of a liquid fuel delivery system in accordance with one embodiment of the present invention.

FIG. 2 illustrates a fuel delivery system in a service station environment according to one embodiment of the present invention. A fuel dispenser 10 delivers fuel 12 from an underground storage tank (UST) 14 to a vehicle. Fuel dispenser 10 has a dispenser housing 16 that typically contains an electronic control system 18 and a display 20. Various fuel handling components, such as valves and meters, are also located inside of housing 16. These fuel handling components allow fuel 12 to be received from underground piping and delivered through a hose and nozzle to a vehicle, as is well understood.

As noted above, fuel 12 is stored in UST 14. Those of skill in the art will appreciate that there may be a plurality of USTs 14 in a service station environment if more than one type or grade of fuel 12 is to be delivered by fuel dispensers 10. In this case, UST 14 is a double-walled tank having an inner vessel 22 that holds the fuel 12 surrounded by an outer casing 24. Any leaked fuel 12 from a leak in inner vessel 22 will be captured in an interstitial space 26 that is formed between inner vessel 22 and outer casing 24. More information on underground storage tanks in service station environments can be found in U.S. Pat. No. 6,116,815, incorporated herein by reference in its entirety for all purposes.

A unitized motor and pump (UMP) 30 is provided to draw fuel 12 from UST 14 and deliver it to fuel dispenser(s) 10. One example of a prior art UMP is the RED JACKET® submersible turbine pump, manufactured by Veeder-Root Co. of Simsbury, Conn. Another example of a prior art UMP is disclosed in U.S. Pat. No. 6,126,409, incorporated herein by reference in its entirety for all purposes. UMP 30 is modified from the prior art to utilize a magnetic clutch for controlling downstream pressure as will be described herein.

UMP 30 includes a distribution head 32 that incorporates power and control electronics. The distribution head 32 is typically placed inside a sump 34. Electronics in the distribution head 32 may be communicatively coupled to a tank monitor 36, site controller 38, or other control system via a communication line 40. An example of a tank monitor 36 is the TLS-450 manufactured by the Veeder-Root Co. An example of a site controller 38 is PASSPORT® point-of-sale system manufactured by Gilbarco Inc. of Greensboro, N.C.

Distribution head 32 is fluidly connected to a column pipe 42 which provides fluid communication to fuel 12 inside of UST 14. Column pipe 42 is surrounded by a riser pipe 44 which is mounted (using a mount 46) to the top of the UST 14. In particular, the column pipe 42 extends down into the UST 14 and is terminated with a boom 48. Boom 48 is coupled to a pump housing 50 that contains a motor and at least one impeller. The inlet 52 of pump housing 50 is located near the bottom of UST 14 as shown.

In operation, impeller(s) inside the housing 50 rotate to draw fuel 12 into the housing inlet 52 and thus into the boom 48. The fuel 12 is pushed through column pipe 42 and delivered to the main fuel piping conduit 54. In this embodiment, main fuel piping conduit 54 is a double-walled piping having an interstitial space 56 formed by outer wall 58 to capture any leaked fuel. Finally, main fuel piping conduit 54 is coupled to the fuel dispensers 10 in the service station whereby fuel 12 is delivered to a vehicle.

Figure 3:
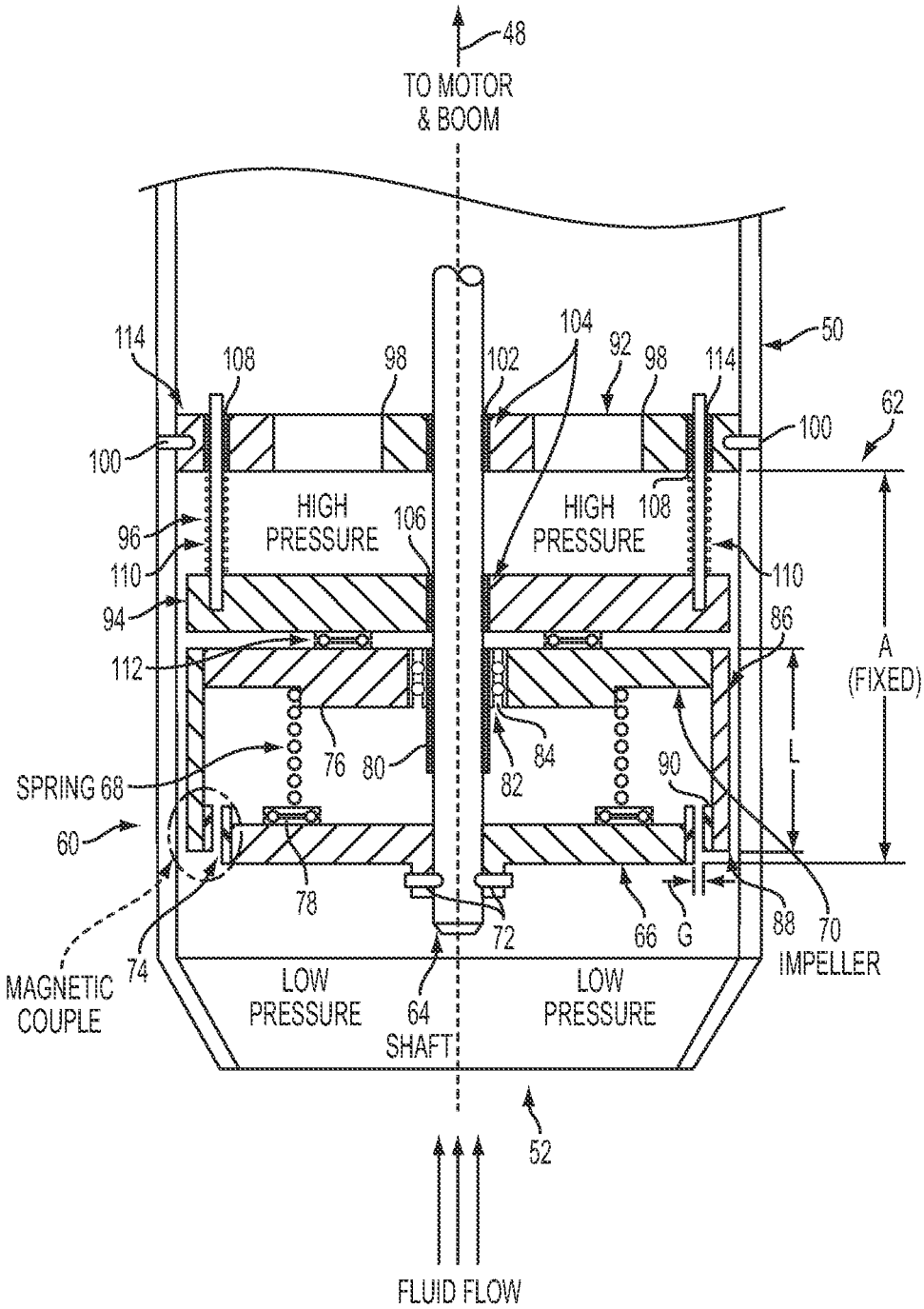
FIG. 3 is a diagrammatic partial cross section of a unitized motor and pump (UMP) having a magnetic clutch activated impeller in accordance with one embodiment of the present invention.

FIG. 3 illustrates the lower portion of pump housing 50 showing a magnetic clutch activated impeller in accordance with one embodiment of the present invention. Those of skill in the art will appreciate that UMP 30 may comprise more than one magnetic clutch driven impeller, as needed or desired. For simplicity of explanation, however, only one magnetic clutch driven impeller is discussed below. Further, although the below discussion contemplates a magnetic clutch of the eddy-current type, those of skill in the art will appreciate that other types of magnetic clutches may be used.

In one embodiment, housing 50 contains a magnetic clutch assembly 60 and a pressure control assembly 62 positioned axially along pump shaft 64. A motor located downstream of pressure control assembly 62 in housing 50 is in electrical communication with distribution head 32 and is operative to rotate pump shaft 64.

In this embodiment, magnetic clutch assembly 60 comprises an impeller control disc 66 which rotates with shaft 64, a spring 68, and an impeller 70 which is magnetically coupled with control disc 66 as described in more detail below. Control disc 66 may be configured as a wheel-like structure formed of steel or other suitable material. This structure defines a plurality of radial ribs which allow liquid fuel to pass through disc 66. Impeller control disc 66 is preferably keyed to shaft 64 to prevent relative rotation therebetween. Set screws 72 or the like may be used as necessary or desired to maintain disc 66 in position. Importantly, control disc 66 is also provided with a circumferential array of closely-spaced permanent magnets 74. The magnets 74 are arranged such that their poles alternate between North and South.

Spring 68 is fixed between a flange 76 of impeller 70 and thrust bearing 78. Spring 68 may preferably be a helical compression spring that is preloaded by an amount sufficient to resist further compression until a predefined pressure in UMP 30 is reached. Because impeller 70 typically has a lower rotational speed than control disc 66, thrust bearing 78 is provided to facilitate relative rotational motion between spring 68 (which rotates with impeller 70) and control disc 66. Thrust bearing 78 also supports axial compression of spring 68 as the pressure in UMP 30 increases.

Impeller 70 is preferably a radial flow impeller comprising a plurality of vanes supported by a shroud as is well understood. In this embodiment, shaft 64 is provided with a sleeve 80, to which the inner race of radial ball bearing 82 is slidably affixed. Impeller 70 is received over shaft 64 such that the outer race of bearing 82 is affixed to central bore 84 of impeller 70. Bearing 82 thus facilitates relative rotation between shaft 64 and impeller 70. Sleeve 80 is preferably formed of a low friction material, such as polytetrafluoroethylene (PTFE), to allow bearing 82 and impeller 70 to translate along the axis of shaft 64 to the extent of sleeve 80. Thus, impeller 70 may both rotate at a speed independent of shaft 64 and move axially along shaft 64 when the pressure in UMP 30 overcomes the preload in spring 68.

A cylinder 86, preferably formed of steel, is affixed to the peripheral edge of impeller 70. Cylinder 86 preferably has a length L such that when spring 68 is in its initial, preloaded state, distal end 88 of cylinder 86 overlaps peripheral magnets 74 on control disc 66. In one embodiment, cylinder 86 is provided with a ring 90 of highly conductive material (e.g., aluminum or copper) affixed to its interior peripheral edge and flush with distal end 88. There is preferably a small gap G between magnets 74 and ring 90 sufficient to allow control disc 66 and impeller 70 to rotate freely.

Those of skill in the art will appreciate that as shaft 64 and control disc 66 rotate, the array of magnets 74 on control disc 66 apply a time-varying magnetic field to the conductive ring 90 to induce eddy currents therein. The eddy currents in the conductive ring 90 create an electromagnetic force (EMF) that acts to oppose the field applied by control disc 66. The interaction of these fields causes the ring 90 (and thus the cylinder 86 and impeller 70) to rotate with the control disc (and shaft 64). However, because relative motion is required to produce the time-varying magnetic field, the rotational speed of the impeller will be less than the rotational speed of shaft 64 and control disc 66. This difference in speed is referred to as "slip."

The torque that the input shaft 64 imparts to the impeller 70 is directly proportional to the flux density of the magnetic field applied by magnets 74 to conductive ring 90 and to the EMF induced in ring 90. The flux density through conductive ring 90 will depend on the amount of surface area perpendicular to the magnetic field induced by the magnets 74. Thus, for example, the strength of the coupling will increase as the overlap increases between the conductive ring 90 on the cylinder 86 and the peripheral array of magnets 74 on the control disc 66. (In addition, the strength of the coupling will increase as the gap G between the conductive ring 90 on the cylinder 86 and the magnetic array 74 on control disc 66 decreases. Thus, those of skill in the art can select a suitable value for dimension G based on various factors.)

Further, the EMF induced in ring 90 is related to the time rate of change of magnetic flux. Generally, as the difference in rotational speed between control disc 66 and cylinder 86 increases, the rate of change of flux increases. Thus, the torque transferred from shaft 64 is proportional to the slip. For example, to compensate for an increase in load torque on the impeller 70 (e.g., when pressure increases), the slip will also increase (i.e., the rotational speed of impeller 70, cylinder 86, and ring 90 will decrease relative to the rotational speed of shaft 64 and control disc 66, which remains constant). Where control disc 66 is rotating at a much higher speed than cylinder 86, there is a high rate of change of magnetic flux, which generates a large EMF and hence the larger torque required. Notably, because the rotational speed of impeller 70 has decreased, the rate of pressure increase across UMP 30 will also decrease.

The pressure control assembly 62 comprises a support disc 92, a diffuser 94, and a plurality of spring-loaded guide pins 96. Support disc 92 is preferably formed of steel and defines a plurality of apertures 98 to allow liquid fuel to flow therethrough. Support disc 92 is fixed to housing 50 via suitable mounting hardware 100 and thus does not rotate with or translate along shaft 64. Shaft 64 penetrates a central bore 102 of support disc 92 and may be provided with a bushing sleeve 104. In any case, the diameter of central bore 102 is large enough for shaft 64 to rotate freely without contacting support disc 92. In alternative embodiments, a bearing may be provided in central bore 102.

Diffuser 94 is mounted on spring-loaded guide pins 96 in close proximity to impeller 70. Shaft 64, which may be provided with a bushing sleeve 104, penetrates a central bore 106 of diffuser 94. As with bore 102 of support disc 92, the diameter of bore 106 is sufficiently large to allow shaft 64 to rotate freely in relation to diffuser 94. Diffuser 94 defines a plurality of stationary guide vanes to direct the liquid fuel axially as it is thrust radially upwards by impeller 70. Thus, guide pins 96 are preferably slidably mounted in a plurality of bores 108 angularly spaced about diffuser 94 to support diffuser 94 for axial movement while preventing its rotation. In some exemplary embodiments, four guide pins 96 may be provided. Springs 110, which may be compression springs having a smaller spring constant than spring 68, are fixed on guide pins 96 between support disc 92 and diffuser 94 to maintain diffuser 94 and impeller 70 in close proximity.

Diffuser 94 will thus translate axially along shaft 64 toward control disc 66 when the downstream pressure in UMP 30 increases above the preload of spring 68. A thrust bearing 112 is provided between diffuser 94 and impeller 70 to receive the axial load of diffuser 94 while allowing relative rotation between impeller 70 and diffuser 94. Slide bearings 114 may be mounted in bores 108 of support disc 92 to facilitate linear motion of guide pins 96 as springs 110 compress and expand.

The configuration of components of magnetic clutch assembly 60 may be altered within the scope of the present invention. For example, the configuration of impeller 70 and control disc 66 may be reversed in some embodiments, such that impeller 70 is disposed upstream of control disc 66. Further, in some embodiments the magnetic coupling may be proximate impeller 70 rather than control disc 66; in such a case, cylinder 86 may be affixed to the periphery of control disc 66 and magnetic array 74 may be provided on impeller 70. Moreover, the positions of ring 90 and magnetic array 74 may be reversed, such that ring 90 is coupled with control disc 66 and magnetic array 74 is coupled with cylinder 86. Those of skill in the art will appreciate that additional configurations are contemplated.

Figure 4:
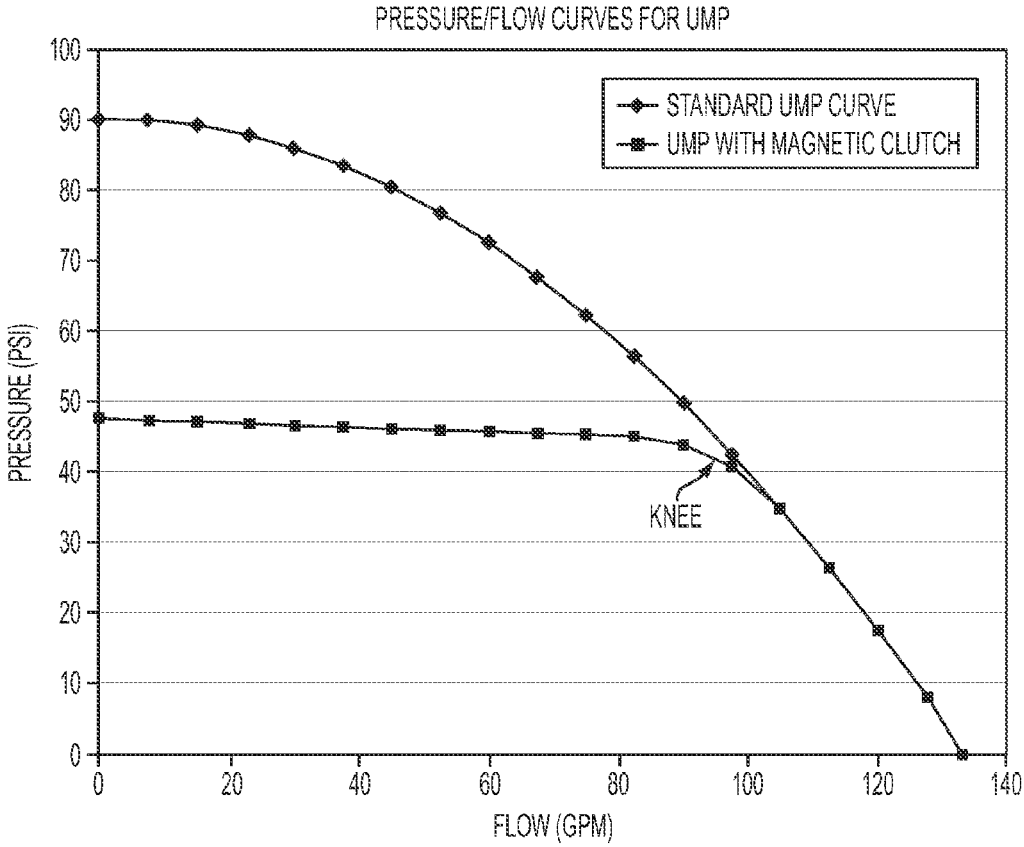
FIG. 4 is an exemplary graph illustrating the relationship between pressure and flow rate of liquid fuel for a standard constant speed UMP and a UMP having the magnetic clutch activated impeller of FIG. 3.

Referring now to FIG. 4, the operation of the magnetic clutch operated impeller of UMP 30 will be described. In particular, FIG. 4 illustrates an exemplary relationship between pressure and flow rate of liquid fuel in a standard constant speed UMP in comparison with a UMP having the magnetic clutch activated impeller of FIG. 3. In a standard UMP, the pressure steadily increases as flow rate decreases, approaching a maximum at very low flow rates. There is concern that the high pressures caused by low and no flow conditions may damage the UMP.

In contrast, in a UMP having the magnetic clutch activated impeller of FIG. 3, the magnetic clutch assembly 60 and the pressure control assembly 62 cooperate to reduce the rate of increase in pressure across UMP 30 as flow rate decreases and maintain the pressure at a desirably lower level. More specifically, during a high flow condition, such as when all nozzles are open, the pressure across UMP 30 is relatively low. In this case, the load torque on impeller 70 is also relatively low, so the relative velocity (i.e., slip) between the impeller 70 and the control disc 66 will also be low.

As noted above, as nozzles begin to close and the flow rate decreases, the pressure across UMP 30 will increase. Because diffuser 94 may translate axially, this pressure increase will force diffuser 94 toward control disc 66. However, preloaded spring 68 will counteract this force. As a result, impeller 70 and diffuser 94 will be maintained in a fixed location along the axis of shaft 64 until the pressure increases above a predetermined threshold.

When the pressure increases such that the force on diffuser 94 and impeller 70 is greater than the preload of spring 68, spring 68 will begin to compress and the diffuser 94 and impeller 70 will begin to translate axially along shaft 64 toward control disc 66. As the impeller 70 translates toward control disc 66, conductive ring 90 will move axially away from magnetic array 74. This reduces the amount of conductive ring 90 perpendicular to the magnetic field of magnetic array 74 and hence reduces the torque imparted by control disc 66.

Importantly, the reduced rotational speed of impeller 70 caused by the reduction in surface area perpendicular to the magnets 74 substantially reduces the rate at which pressure will increase in UMP 30. The change in slope of the pressure-flow curve which occurs as the preload of spring 68 is overcome is labeled in FIG. 4 as a "knee." Those of skill in the art may select the preload such that the knee occurs at a predetermined pressure level in UMP 30. As the flow rate continues to decrease beyond the knee, the pressure will be relatively stable because the magnetic clutch will continue to adjust to slight increases in pressure as described above. The slope of the pressure-flow curve beyond the knee is determined by the spring constant K of spring 68.

When customers begin to dispense fuel again and the flow becomes less restricted, the downstream pressure at UMP 30 will decrease. This causes spring 68 to uncompress, the surface area of ring 90 perpendicular to the magnetic field to increase, and control ring 66 to impart more torque to impeller 70. To compensate, the relative velocity between impeller 70 and control disc 66 will decrease (i.e., the impeller 70 will increase in speed relative to control disc 66). The slip will thus decrease until the torque imparted from shaft 64 and control ring 66 is equal to the load torque, when the system will be at equilibrium.

Figure 5:
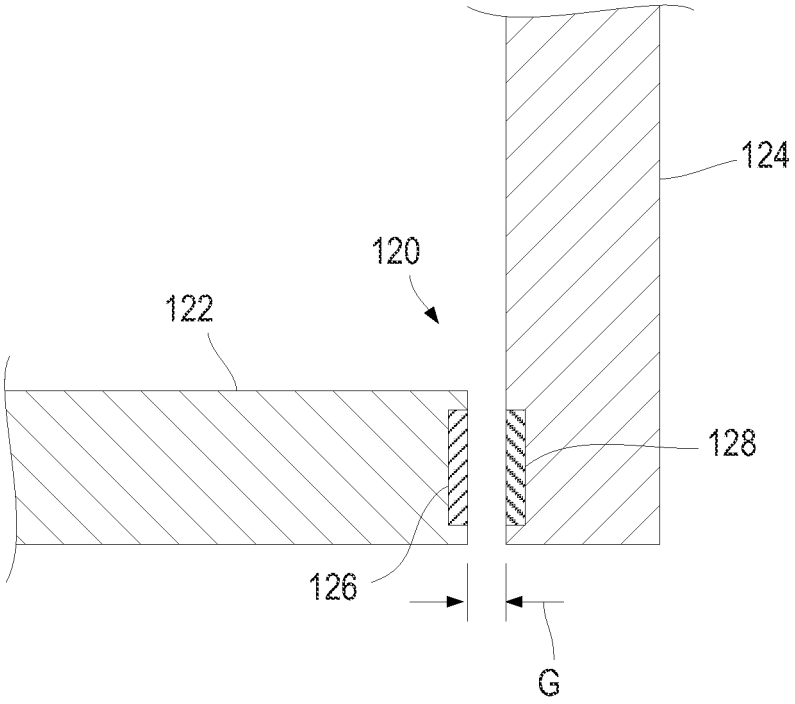
FIG. 5 is an enlarged partial cross section of a magnetic coupling between the impeller and the control disc of a UMP constructed in accordance with an alternative embodiment of the present invention.

According to a further embodiment, the impeller of a UMP may be driven using a synchronous magnetic coupling. More particularly, FIG. 5 is an enlarged view of a synchronous magnetic coupling, generally indicated at 120, between a control disc 122 and a cylinder 124. Control disc 122 and cylinder 124 may preferably be analogous to control disc 66 and cylinder 86 such that rotation of control disc 122 causes rotation of cylinder 124 (and its associated impeller) as described below.

In this embodiment, control disc 122 is provided on its circumference with a low energy, ferromagnetic material 126. Material 126 may preferably be Alnico 5 or a similar material. It is known that such materials can be magnetized to produce permanent magnets. In some embodiments of the present invention, however, material 126 is not magnetized prior to installation on control disc 122. Additionally, cylinder 124 is provided with an array of high energy magnets 128 affixed to its interior peripheral edge. Magnets 128, which may preferably be formed of Somarium Cobalt or Neodymium, are preferably arranged such that their poles alternate between North and South. It will be appreciated that the arrangement of material 126 and magnets 128 may be reversed, such that material 126 is provided on cylinder 124 and magnets 128 are provided on control disc 122. As discussed above, there is preferably a small gap G between magnets 128 and material 126 sufficient to allow control disc 122 and the impeller to rotate freely.

In many embodiments, it may be desirable to configure material 126 as a plurality of individual elements respectively opposing each magnet 128 (although in other embodiments material 126 may be provided as a continuous ring). Where material 126 is configured as a plurality of individual elements, each element will magnetize "ad hoc" (i.e., acquire a polarity opposite its corresponding magnet 128) such that cylinder 124 will "track," or rotate with, control disc 122 in a synchronous fashion. Thereby, cylinder 124 (and, thus, the impeller) will not slip at low torques. Higher torques may cause cylinder 124 to slip relative to control disc 122, although magnetic coupling 120 may still transmit torque to the impeller. In particular, as cylinder 124 slips relative to control disc 122, elements of material 126 will repolarize at a rapid rate. This repolarization causes a recovery torque as the elements of material 126 attempt to realign with magnets 128. Thus, this recovery torque operates to limit the amount of slip which occurs. It will be appreciated that the physical characteristics of magnetic coupling 120 may be selected to produce slip at a desired torque level.

The coupling between material 126 and magnets 128 will tend to counteract axial movement of the impeller toward control disc 122, and thus spring 68 may not be necessary in this embodiment. However, because the force of magnetic coupling 120 counteracting axial movement of the impeller is nonlinear, a spring analogous to spring 68 may be disposed between the impeller and control disc 122 to provide linearity.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A pumping apparatus comprising a pump housing disposed in a storage tank and in fluid communication with fluid piping, said pumping apparatus comprising:

a rotatable shaft;

at least one magnetic clutch assembly coupled with said shaft and configured to pump fluid from said storage tank through said pump housing to said fluid piping, said at least one magnetic clutch assembly comprising:

an impeller;

a control structure;

a magnetic coupling between said impeller and said control structure, said magnetic coupling defined by a conductive portion and a plurality of magnets proximate said conductive portion such that rotation of said control structure causes rotation of said impeller;

wherein said impeller is configured to travel along said shaft relative to said control structure in response to a change in downstream pressure.

2. The pumping apparatus of claim 1, wherein said at least one magnetic clutch assembly comprises more than one magnetic clutch assembly.

3. The pumping apparatus of claim 1, wherein the torque imparted by said control structure to said impeller is related to the flux density of the magnetic field applied by said plurality of magnets to said conductive portion.

4. The pumping apparatus of claim 1, wherein said impeller comprises said conductive portion and said control structure comprises said plurality of magnets.

5. The pumping apparatus of claim 4, wherein said impeller travels along said shaft toward said control structure in response to an increase in downstream pressure.

6. The pumping apparatus of claim 1, further comprising a diffuser downstream of said impeller to direct said pumped fluid axially.

7. The pumping apparatus of claim 6, wherein said diffuser is coupled with said impeller and configured to travel along said shaft.

8. The pumping apparatus of claim 6, further comprising a thrust bearing disposed between said diffuser and said impeller to allow said impeller to rotate relative to said diffuser.

9. The pumping apparatus of claim 6, further comprising a support structure mounted to said pump housing, said support structure coupled with said diffuser.

10. The pumping apparatus of claim 9, wherein said diffuser is coupled with said support structure via at least one spring-loaded guide pin.

11. A pumping apparatus comprising:

a rotatable shaft coupled to a motor;

at least one control structure mounted on said shaft;

at least one impeller carried by said shaft, wherein said impeller is adapted to rotate independently of said shaft so as to pump a fluid; and a magnetic coupling between said control structure and said impeller;

wherein said impeller is adapted to translate axially along said shaft in response to a change in downstream pressure to alter the strength of said magnetic coupling.

12. The apparatus of claim 11, further comprising at least one compression spring disposed along said shaft between said control structure and said impeller, said spring having a preload.

13. The apparatus of claim 12, wherein the magnitude of said preload is selected to cause said spring to resist compression until said downstream pressure reaches a predetermined pressure.

14. The apparatus of claim 11, wherein said control structure is upstream of said impeller.

15. The apparatus of claim 11, wherein said magnetic coupling comprises an array of magnets coupled with said control structure and a conductive ring coupled with said impeller.

16. The apparatus of claim 15, wherein said conductive ring is carried by a steel cylinder attached to a peripheral edge of said impeller.

17. The apparatus of claim 11, wherein the rotational speed of said impeller differs from the rotational speed of said control structure.

18. The apparatus of claim 11, further comprising a sleeve received over at least a portion of said shaft, said sleeve being formed of a low friction material.

19. The apparatus of claim 18, further comprising a bearing interposed between said impeller and said sleeve to allow axial translation of said impeller along said shaft so as to facilitate axial movement of said impeller.

20. A method for pumping fluid from a storage tank to fluid piping, said method comprising the steps of:

providing a pump housing having an inlet in fluid communication with said fluid and an outlet in fluid communication with said fluid piping;

providing a rotatable shaft located inside said housing, said shaft being in operative communication with a motor;

coupling an impeller with said shaft, said coupling allowing said impeller to rotate independently of and translate axially along said shaft;

mounting a control structure on said shaft such that said control structure rotates with said shaft;

magnetically coupling said control structure with said impeller;

rotating said control structure to draw said fluid into said inlet using said impeller; and altering the strength of said magnetic coupling between said control structure and said impeller in response to a change in downstream pressure.

21. The method of claim 20, wherein said alteration of the strength of said magnetic coupling is caused by axial translation of said impeller relative to said control structure.

22. The method of claim 21, further comprising affixing a sleeve formed of low friction material over at least a portion of said shaft.

23. The method of claim 22, further comprising providing a bearing between said impeller and said sleeve to allow axial translation of said impeller along said shaft.

24. The method of claim 23, wherein said axial translation occurs at a predetermined pressure.

25. The method of claim 23, further comprising mounting a preloaded compression spring between said impeller and said control structure.

26. The method of claim 20, wherein said magnetic coupling step further comprises providing an array of magnets on said control structure.

27. The method of claim 20, further comprising reducing the rotational speed of said impeller relative to that of said control structure in response to an increase in downstream pressure.

* * * * *